United States Patent [19]

Harders

[11] Patent Number: 4,568,248

[45] Date of Patent: Feb. 4, 1986

[54] ADDITIVE FEEDBACK MONITORING SYSTEM

[76] Inventor: Mark R. Harders, 303 W. Carmen La., #75, Santa Maria, Calif. 93454

[21] Appl. No.: 604,237

[22] Filed: Apr. 26, 1984

[51] Int. Cl.[4] ..... F04B 49/00

[52] U.S. Cl. ..... 417/43; 123/1 A; 123/198 A; 222/14; 307/118; 417/44; 417/53

[58] Field of Search ..... 417/44, 43; 222/14–22; 137/487.5, 565; 123/1 A, 198 A, 25 E, 575, 576, 577; 307/116, 118

[56] References Cited

U.S. PATENT DOCUMENTS

| | | | |
|---|---|---|---|
| 4,161,160 | 7/1979 | Hicks et al. | 123/1 A |
| 4,253,436 | 3/1981 | Dudrey | 123/198 A |
| 4,406,313 | 9/1983 | Bennett et al. | 222/14 X |
| 4,442,953 | 4/1984 | Miyamoto et al. | 222/14 |

*Primary Examiner*—Edward K. Look

*Attorney, Agent, or Firm*—Daniel C. McKown

[57] ABSTRACT

In accordance with the present invention, the actual volume of a liquid chemical additive used to treat fuel is measured by an additive flow transducer so that a desired mix ratio can be maintained. In a first preferred embodiment, the amount of additive measured is converted to an equivalent volume treated fuel, and displayed. The user watches the display and stops adding additive when the display indicates that he has already added sufficient additive to treat the actual amount of fuel to be added to the fuel tank. In a second preferred embodiment, the user sets in the desired mix ratio and the volume of fuel that is to be added to the tank, and an electrically driven pump adds additive to the tank until a desired mix ratio obtains. In a third preferred embodiment, both the cumulative fuel flow and cumulative additive flow are sensed and the rate of additive flow is controlled by an automatic control system seeks to maintain a desired mix ratio.

3 Claims, 3 Drawing Figures

ADDITIVE FEEDBACK MONITORING SYSTEM

BACKGROUND OF THE INVENTION

1. Field of the Invention

The present invention is in the field of internal combustion engines and specifically relates to a system for monitoring the amount of a liquid chemical additive that is added to the fuel on which the engine runs.

2. The Prior Art

In the present invention, the amount of additive to be mixed with the fuel prior to combustion in an engine is measured and controlled. The additive flow rates, in some instances, are extremely low, and the user wishes to be assured that the proper number of ounces of additive are with a certain number of gallons of fuel.

Several workers in the field have proposed systems for accomplishing this end, and some of the more pertinent systems will be discussed below. From that discussion it will become apparent that none of the systems disclosed in the known prior art permits the user to know whether the system is actually functioning.

For example, in U.S. Pat. No. 4,346,689 Neely discloses an electric pump operated from the dash board of a vehicle, and which pumps additive into the fuel line at a point between the fuel pump and the carburetor. Neely provides a bypass injection line which permits the fuel filters to be bypassed so that the treated fuel can pass directly into the carburetor.

In U.S. Pat. No. 4,161,160 issued to Hicks, et al. on July 17, 1979, there is disclosed a system for adding additive to the fuel line between the fuel supply and the fuel pump. Because the additive is expensive, a selectively operated valve is provided to limit the flow of additive to the time required for the engine to warm up. A small orifice is installed in the additive supply line to limit the flow of additive into the fuel line.

In U.S. Pat. No. 3,148,670 issued Sept. 15, 1964 to Fiedler, et al. there is disclosed a system in which additive is forced under pressure to flow into the fuel line through a tee.

In U.S. Pat. No. 4,253,436 issued Mar. 3, 1981 to Dudrey, there is shown a liquid fuel and additive mixing apparatus that uses a timer calibrated in gallons to operate a constant pressure pump. An orifice limits the flow rate of the additive.

One problem common to all of these prior art systems is that there is no way of determining whether the system is functioning properly or of being assured that the additive is actually reaching its destination in the desired quantity. As will be seen below, the system of the present invention overcomes this basic problem of the prior art systems.

SUMMARY OF THE INVENTION

In accordance with the present invention, an additive flow transducer is located between the additive reservoir and the part of the fuel system into which the additive is to be fed. The additive flow transducer measures the actual amount of additive that is being provided to the fuel tank or fuel line. That information is used to control the amount of additive used.

In a first preferred embodiment of the invention, referred to below as the manual system, the amount of additive that has been added to the fuel tank is measured by the additive flow transducer, the output of which is processed by electronic circuitry and displayed for the user in terms of the number of gallons of fuel treated.

The user then operates a mechanical pump until the display indicates that the desired quantity of additive has been added to the fuel tank.

In a second preferred embodiment, referred to below as the electrical system, the user sets the desired mix ratio and inputs the number of gallons of fuel to be treated. Thereafter, a pump transfers additive to the fuel tank, and the amount of additive added to the fuel tank is sensed by the additive flow transducer. The signal from the additive flow transducer is processed electronically and used to turn off the additive pump when the proper amount of additive has been transferred.

In a third preferred embodiment of the present invention, referred to below as the automatic system, additive is drawn into the fuel line by a venturi effect. In this embodiment, the additive is added continuously as the fuel moves through the fuel line. The cumulative quantity of additive that has been supplied is determined from an additive flow transducer. The corresponding cumulative amount of fuel is determined by a fuel flow transducer. A feedback system uses the fuel and additive flow information to determine whether the additive is being added too rapidly or too slowly, that is, to generate an error signal. The error signal is used to control a needle valve in the additive line so as continually to adjust the additive flow rate to achieve a desired mix ratio.

Thus, it is seen that in each of the three preferred embodiments, an additive flow transducer is used as part of a control circuit so that the addition of the additive is determined and regulated by the quantity of additive actually used, so as to achieve a desired mix ratio.

Sofar as can be determined, additive systems known in the prior art have not employed feedback control systems, with the result that the desired mix ratio is not achieved.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
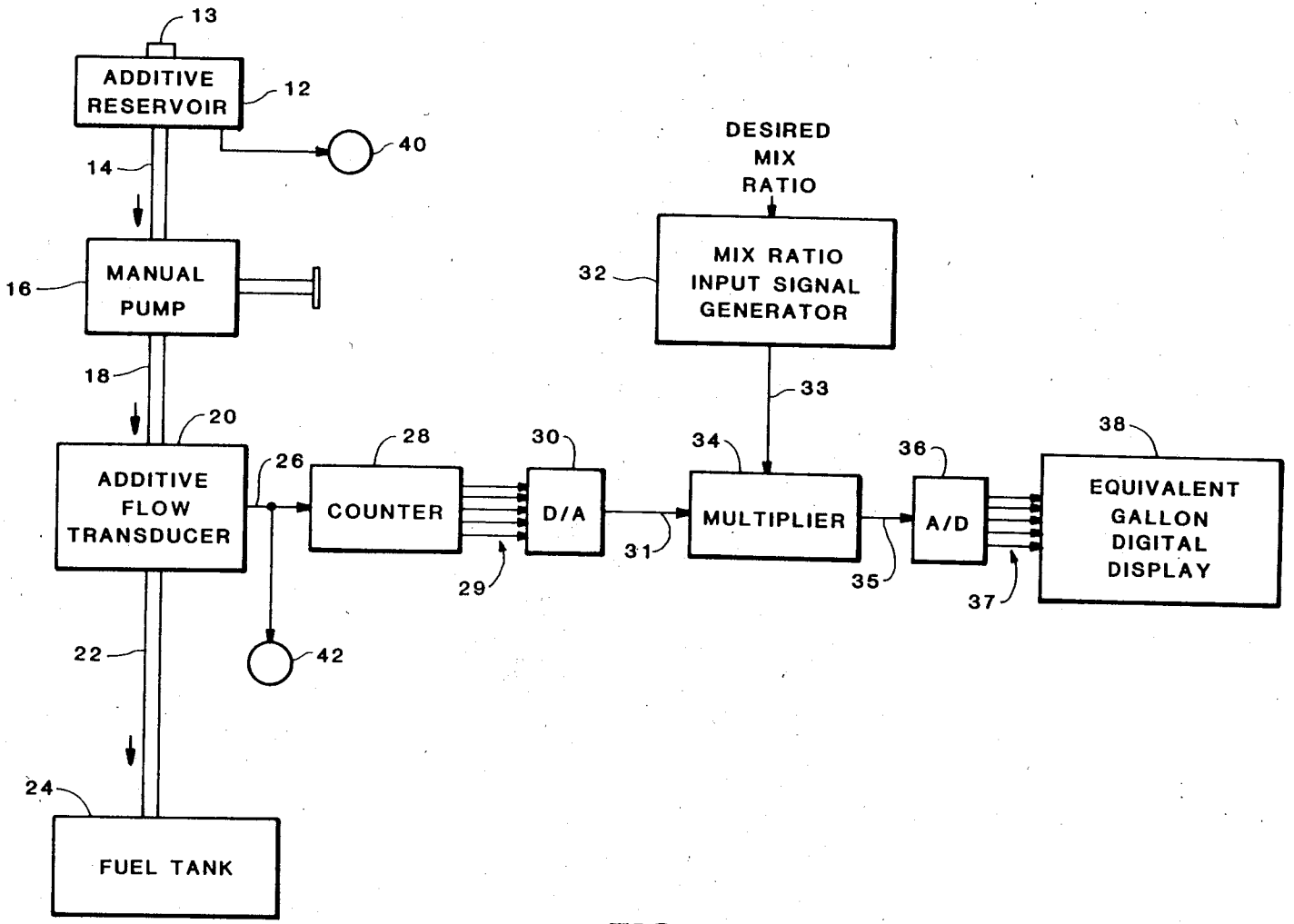
FIG. 1 is an electrical and hydraulic diagram showing a first preferred embodiment of the present invention.

Three preferred embodiments of the invention will be described. They are referred to as the manual system (shown in FIG. 1), the electrical system (shown in FIG. 2), and the automatic system (shown in FIG. 3. In describing the embodiments, like parts will be denoted by the same reference numeral throughout.

Turning now to FIG. 1, which is an electrical and hydraulic diagram, it is seen that the additive is stored in a reservoir 12 that includes a vent 13 for admitting air as the additive is drawn through the conduit 14 from the reservoir 12. The manual pump 16 is operated by the user to draw additive from the reservoir 12 through the conduit 14 and to propel that additive through the conduit 18 and the conduit 22 into the fuel tank 24. Although in this example a fuel tank is shown, it is recognized that in alternative embodiments, the fuel tank could be replaced by some other form of sump.

At some point between the pump 16 and the fuel tank 24, the additive flows through the additive flow transducer 20 that generates an electrical pulse for each incremental volume of flow. The pulses are produced on the conductor 26.

In a preferred embodiment, the flow transducer 20 includes a toroidal tube in which a number of balls are suspended. The flow of the additive through the toroidal tube causes the balls to progress around the toroidal, and in the process to interrupt a light beam that is used with a photoelectric sensor to produce a train of pulses as successive balls pass the location of the light source.

The pulses on the conductor 26 are applied to the counter 28 which counts the pulses to provide an indication of the cumulative flow of additive. The output of the counter 28 is a multi-bite digital number presented by electrical signals on the lines 29. That signal is applied to the digital-to-analog converter 30 which produces in response thereto an analog signal on the line 31.

The signal on the line 31 represents in analog form the cumulative flow of additive through the conduit 18.

It is anticipated that the user will decide what mix ratio he wishes to use and will set a dial or turn a knob on the mix ratio input signal generator 32 to implement the chosen mix ratio. In one embodiment of the invention, the mix ratio input signal generator 32 is merely a potentiometer.

It is also contemplated that the user will add additive to the fuel tank 24 each time the user puts fuel in the fuel tank 24. It is further assumed that the user will know the number of gallons of fuel that he is adding to the fuel tank 24.

First, the user sets the desired mix ratio by use of the mix ratio input signal generator 32. Next, the user operates the manual pump 16 to add additive to the fuel tank. Finally, the user adds the predetermined amount of fuel to the fuel tank.

How does the user know when he has added enough additive to the fuel tank?. In accordance with the present invention, the user watches the equivalent gallon digital display 38 as he operates the manual pump 16, and he continues to operate the manual pump until the increasing reading on the equivalent gallons digital display 38 finally equals the number of gallons of fuel that he intends to add to the fuel tank 24.

The equivalent gallon digital display 38 displays in digital form the number of gallons of fuel that the added additive would be equivalent to treat, assuming the desired mix ratio.

The mix ratio is normally expressed as one ounce of additive per N gallons of fuel, but the dial on the mix ratio input signal generator 32 is labelled with various values of N. The output of the mix ratio input signal generator 32 is an analog signal on the line 33 that is proportional to N. Thus, if the richness of the mixture of additive to fuel is halved, N will be doubled, and the analog signal on the line 33 also will be doubled, and the amount of fuel that can be treated with an ounce of additive will also be doubled.

From this view point it can be seen that the analog signal on the line 31 must be multiplied by the analog signal on the line 33 to produce an analog signal on the line 35 that represents the number of gallons of fuel that can be treated by the amount of additive indicated on the line 31. The analog signal on the line 35 is converted to digital form by the analog-to-digital converter 36, and the digital signal is applied via the lines 37 to the equivalent gallon digital display 38.

Thus, by way of example, if the user wants to add 20 gallons to the fuel tank 24, he then begins to operate the manual pump 16 causing additive to be added to the fuel tank. The amount added is sensed by the additive flow transducer 20 and increases from 0 as the manual pump 16 is operated. The user observes the equivalent gallon digital display 38 as he operates the manual pump 16 and the digital display increases from 0 as the pump is operated. When the number displayed on the digital display 38 equals 20 gallons, the user stops operating the pump 16 because the display 38 is telling him that the amount of additive he has added is sufficient to treat the 20 gallons of fuel he will add, for whatever mix ratio setting the user has inserted into the mix ratio input signal generator 32.

The manual system just described has the advantage of being relatively simple to implement. It should be noted that the feedback is provided by the user who operates the manual pump in response to the number of gallons displayed on the equivalent gallon digital display 38.

In one implementation of this preferred embodiment, the equivalent gallon digital display 38 along with the low-level indicator 40 and the "ON" light 42 are grouped on a panel adjacent the manual pump 16.

Figure 2:
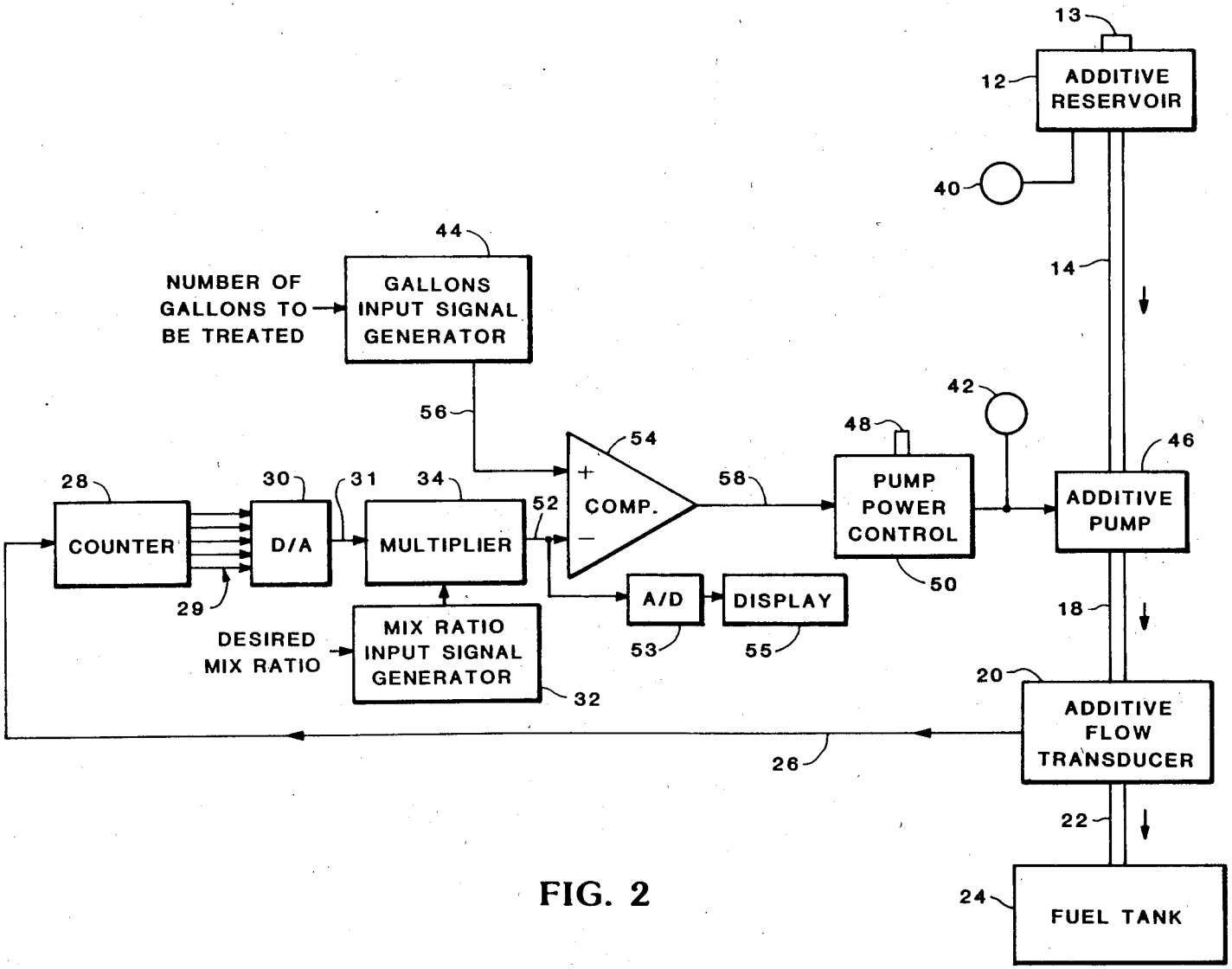
FIG. 2 is an electrical and hydraulic diagram showing a second preferred embodiment of the present invention; and, FIG. 3 is an electrical and hydraulic diagram showing a third preferred embodiment of the present invention.

A second preferred embodiment of the present invention is shown in the electrical and hydraulic diagram of FIG. 2. That embodiment is referred to as the electrical embodiment.

This second preferred embodiment differs from the first preferred embodiment in that the user sets into the apparatus the number of gallons of fuel to be treated and in that the additive pump is electrical rather than mechanical. The second embodiment is further distinguished in that the operation of the additive pump is controlled by a feedback circuit, rather than by the user.

In the second preferred embodiment, the user turns on the apparatus and sets into the apparatus both the mix ratio he desires and the number of gallons to be treated. The desired mix ratio is set into the mix ratio input signal generator 32 by the user. Next, the number of gallons to be treated is set into the gallons input signal generator 44. Thereafter, the user applies electrical power to the additive pump 46 by the use of a switch 48 that is associated with the pump power control circuit 50. The indicator light 42 comes on to indicate that the additive pump 46 is in operation.

The additive pump 46 draws additive through the conduit 14 and forces the additive through the conduit 18, through the additive flow transducer 20, through the conduit 22 and into the fuel tank 24.

A preferred type of additive flow transducer was described above in connection with the first preferred embodiment, and a similar transducer is employed in the second preferred embodiment. As described above, the output of the additive flow transducer 20 is a sequence of pulses on the line 26. These pulses are counted by the counter 28 to obtain a digital measure on the lines 29 of the cumulative flow. The cumulative flow is then converted to an analog form by the digital-to-analog converter 30 so that the signal on the line 31 is an analog representation of the cumulative flow of additive during the present cycle of operation of the apparatus.

The cumulative amount of additive added up to some instant of time in a given cycle of operation is then converted into a signal on the line 52 that indicates the amount of fuel that could be treated with that amount of additive. This information is converted to digital form by the A/D converter 53 for presentation on the display 55. For example, if the desired mix ratio is one ounce of additive to 50 gallons of fuel and if two ounces of additive have been pumped into the fuel tank, then that amount of additive is sufficient to treat 100 gallons of fuel. Therefore, in the multiplier 34, the cumulative flow of additive on the line 31 is multiplied by the desired mix ratio expressed in gallons of fuel per ounce of additive.

As additive is added to the fuel tank by the additive pump 46, the equivalent number of gallons treated, as represented by the analog signal on the line 52, gradually increases. This signal on the line 52 is continually compared by the comparator 54 with the number of gallons to be treated, as represented by an analog signal on the line 56. As long as the equivalent number of gallons that have been treated up to some point is less than the total number of gallons to be treated, the output of the comparator 54 on the line 58 is positive. However, when sufficient additive has been added to the fuel tank, the output of the comparator 54 has become equal to 0.

The pump power control circuit 50 includes an electronic switch that remains closed so long as its control input on the line 58 is greater than 0. The pump power circuit is designed in such a manner that when its input reaches 0 or becomes negative, the switch is opened. The design of such a circuit is well within the capabilities of one skilled in the art.

The pump power control circuit 50 thus controls the operation of the additive pump 46 by applying power to it so long as the signal on the line 58 is positive and by holding off the flow of current to the additive pump 46 as long as the signal on the line 58 is 0 or negative. In this way, when the proper amount of additive has been added to the fuel tank to treat the number of gallons that were to be treated, the additive pump 46 shuts off and the "ON" light 42 goes off. At that point, the cycle of operation of the apparatus is complete.

Figure 3:
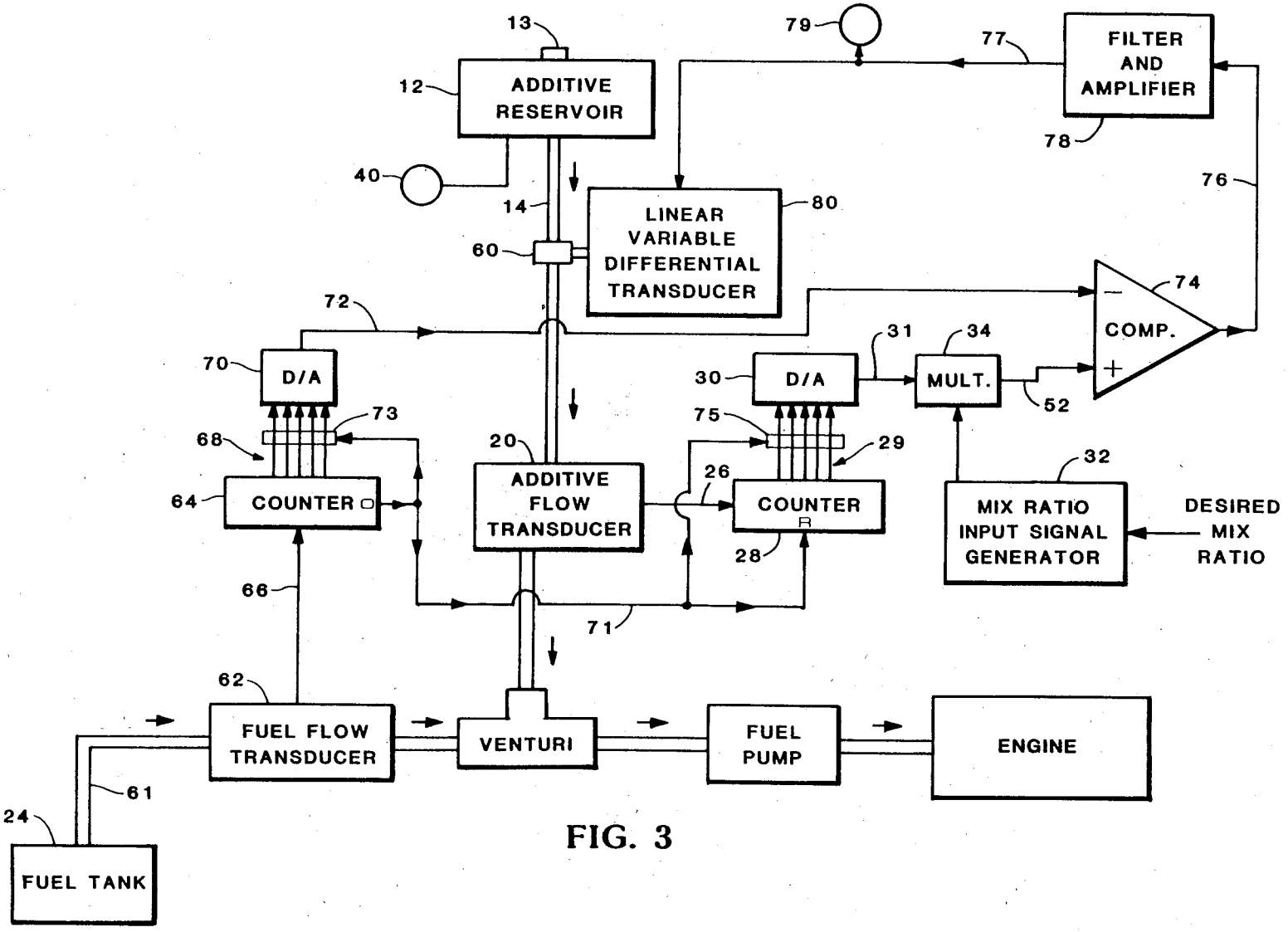

FIG. 3 shows a third preferred embodiment of the present invention. This third preferred embodiment is referred to as the automatic system and its day-to-day operation does not require the intervention of the user.

In the third embodiment, there is no additive pump as such. Instead, the additive is drawn into the fuel line through a venturi. However, before reaching the venturi, the additive must flow from the additive reservoir 12 through the conduit 14 through the additive flow valve 60, and through the additive flow transducer 20. As in the first and second preferred embodiments, the additive flow transducer 20 generates a sequence of pulses on the line 26 which are counted by the counter 28, and converted to analog form by the digital-to-analog converter 30. The output signal on the line 31 is an analog representation of the cumulative amount of additive that has flowed into the fuel line in a particular cycle of operation. As in the first and second preferred embodiments, the signal on the line 31 is multiplied by the mix ratio (expressed in gallons of fuel per ounce of additive) which is set into the mix ratio input signal generator 32 by the user. The multiplication is performed in the multiplier 34, and the output of the multiplier on the line 52 is an analog signal representing the number of gallons of fuel that the cumulative flow of additive could treat at the desired mix ratio.

Simultaneously, the amount of fuel flowing through the fuel line 61 is sensed by the fuel flow transducer 62 which produces a sequence of pulses on the line 66, each of which represents the same quantity of fuel. The pulses on the line 66 are counted in the counter 64 to produce a digital representation on the lines 68 of the cumulative flow during a particular cycle of operation. The digital representation on the lines 68 is converted to an analog representation on the line 72 by the digital-to-analog converter 70.

The comparator 74 thus compares the signal on the line 72 which represents the cumulative volume of fuel flow expressed in gallons, with the signal on the line 52 which represents the volume of fuel, in gallons, that could be treated by the actual amount of additive that was consumed during a particular cycle of operation.

If the cumulative fuel flow exceeds the number of gallons that could have been treated by the additive flow, it indicates that an insufficient amount of additive is being used relative to the desired mix ratio, and the output of the comparator 74 is negative. On the other hand, if the cumulative volume of fuel flow is less than the volume of fuel that can be treated by the cumulative additive flow, it means that too much additive is being used to the relative desired mix ratio. In this event, the output of the comparator 74 is positive.

The output of the comparator 74 is thus a signal on the line 76 that may be either positive or negative. That signal is filtered and amplified by the circuit 78 that includes a filter having a long time constant. The output of the circuit 78 on the line 77 is applied to the linear variable differential transducer 80 that controls the additive flow control valve 60. The control is exercised in such a manner that a positive output from the comparator 74, which indicates too such additive being used, results in the additive flow control valve 60 being closed somewhat to throttle the flow of additive to the venturi. On the other hand, if the output of the comparator 74 is negative, the linear variable differential transducer 80 opens the value 60 to permit a greater flow of additive.

The indicator 79 may be of a type, known in the art, that glows red when the signal on the line 77 is positive and glows green when the signal on the line 77 is negative.

Thus, it is seen that the system of FIG. 3 is operative to maintain a desired mix ratio between the measured fuel flow and the measured additive flow and to adjust the additive flow in the event it is too large or too small.

The cycle of operation of the third preferred embodiment begins when power is applied to the electronic circuits shown in FIG. 3. The cycle of operation continues until either of two events occurs. The first event is that the power to the system may be turned off, in which event, the counters 28, 64 are reset to 0. A second event that could terminate the cycle of operation is when the counter 64 overflows. When the overflow of counter 64 occurs, an overflow signal is generated on the line 71, and this signal is used to reset the counter 28. The overflow signal on the line 71 also operates the latches 73 and 75 thereby temporarily holding the inputs to the D/A converters 30, 70 constant until the count on the counter 28 has time to accumulate to a chosen valve; otherwise, each increment of the counter 28 would cause an undesirably large transient in the output of the comparator 74. To further reduce the transients that necessarily result when the counters increment, a filter having a relatively long time constant is placed in the control loop circuit 78.

Thus, there have been described three preferred embodiments of the present invention. In each embodiment, the actual amount of additive entering the fuel tank is measured, and some measure of control is based upon that measurement. In the first preferred embodiment, the measured value is used to operate a display which the user watches as he operates a manual additive pump. In the second preferred embodiment, the measured amount of additive is used by a control circuit to determine whether sufficient additive has been added to treat the amount of fuel that was added to the fuel tank. In the third preferred embodiment, the actual amount of fuel that is drawn into the fuel line through a venturi is measured and is compared with the amount of fuel used by means of a control system.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A method of achieving in a fuel tank a desired mix ratio of additive to fuel comprising the steps of:

(a) adding a quantity of fuel to the fuel tank;

(b) starting to transfer additive to the fuel tank and continually measuring the rate of flow of the additive to the fuel tank;

(c) determining at each instant the cumulative amount of additive added to the fuel tank;

(d) converting the cumulative amount of additive added to an equalivalent amount of fuel treated, taking into consideration the desired mix ratio;

(e) terminating the transfer of additive to the fuel tank when the equivalent amount of fuel treated equals the quantity of fuel added to the fuel tank.

2. The method of claim 1 wherein step (d) further comprises multiplying the cumulative amount of additive added by the desired mix ratio of fuel to additive to obtain the equivalent amount of fuel treated.

3. Apparatus for transferring from an additive reservoir to a fuel tank the correct amount of an additive when fuel is added to the fuel tank by an opertor to achieve a desired mix ratio of additive to fuel, said apparatus comprising in combination:

a pump, electrically powered for transferring additive from the additive reservoir to the fuel tank;

a conduit connecting said pump to the fuel tank;

first means located along said conduit for determining at each instant the cumulative quantity of additive added to the fuel tank and for producing a first signal representing the cumulative quantity of additive added to the fuel tank;

input means controlled by the operator for generating a mix ratio signal;

second means connected to said first means and to said input means, responsive to said first signal and to said mix ratio signal to produce a second signal representing an equivalent quantity of fuel treated;

fuel added input means set by the operator for producing a fuel added signal representative of the quantity of fuel added to the fuel tank;

comparator means connected to said second means and to said fuel added input means, for producing an output signal that represents the difference between the fuel added and the equivalent quantity of fuel treated;

pump control means connected to said comparator means and to said pump, for applying electrical power to the pump when the fuel added exceeds the equivalent quantity of fuel treated and for interrupting the eletrical power to the pump to the pump when the equivalent quantity of fuel treated exceeds the fuel added.

* * * * *